United States Patent [19]

Asmus

[11] Patent Number: 4,545,487

[45] Date of Patent: Oct. 8, 1985

[54] FOOD SERVING TRAY

[75] Inventor: Edward Asmus, Ft. Collins, Colo.

[73] Assignee: Anchor Hocking Corporation, Del.

[21] Appl. No.: 661,491

[22] Filed: Oct. 16, 1984

Related U.S. Application Data

[63] Continuation of Ser. No. 205,721, Nov. 10, 1980, abandoned.

[51] Int. Cl.[4] ..... B65D 21/02; A45C 11/20; A47G 19/02; A47G 23/06

[52] U.S. Cl. ..... 206/508; D9/341; D9/410; 206/509; 206/511; 206/545; 220/4 B; 220/23.6

[58] Field of Search ..... 206/508, 509, 511, 545; 220/4 B, 23.6, 23.8; D9/341, 410

[56] References Cited

U.S. PATENT DOCUMENTS

| | | | |
|---|---|---|---|
| D. 254,599 | 4/1980 | Otto | D9/341 |
| 1,626,930 | 5/1927 | Grogg | 206/508 |
| 2,978,142 | 4/1961 | Novick | 206/508 |
| 3,647,104 | 3/1972 | Goings | 220/23.8 |
| 3,799,386 | 3/1974 | Madalin | 220/23.8 |
| 3,845,875 | 11/1974 | Douglas | 206/545 |
| 3,938,688 | 2/1976 | Ryan | 206/545 |

FOREIGN PATENT DOCUMENTS

| | | | |
|---|---|---|---|
| 1106241 | 5/1961 | Fed. Rep. of Germany | 206/509 |
| 2737800 | 2/1978 | Fed. Rep. of Germany | 220/410 |
| A282431 | 12/1963 | France | 206/508 |

*Primary Examiner*—George E. Lowrance
*Attorney, Agent, or Firm*—Hugh H. Drake

[57] ABSTRACT

A food serving tray has a hood shaped to define a generally planar upper surface along with a downwardly depending first marginal skirt. A generally planar lid has an upwardly projecting second marginal skirt that is bonded to the first skirt. A food support is also of generally planar shape and has a downwardly depending third marginal skirt that is bonded to an upwardly-projecting fourth marginal skirt of a likewise generally planar base. The lid is indexed so as to lie in mating relationship atop the support. A liner desirably covers the support.

6 Claims, 6 Drawing Figures

FOOD SERVING TRAY

This application is a continuation of application Ser. No. 205,721, filed Nov. 10, 1980, abandoned.

The present invention pertains to a food serving tray. More particularly, it relates to a tray of a kind which enables the service of food from a kitchen to a remote location, while yet keeping that food warm and also protected.

Food service in such places as hospitals, nursing homes and the like, as well as on airplanes and other places wherein the kitchen often is located remotely from the consumer, entails the need for sanitary transport of the food at the same time as its temperature is substantially maintained. Accordingly, attention has been given heretofore to a variety of different food serving tray structures which seek to accommodate such remote service. In many cases, the arrangement of the individual trays has been such as to allow their efficient storage and transportation. Examples of such approaches will be found in U.S. Pat. Nos. Des. 219,240, 220,942, 221,349, 226,830, 229,601, 231,424 and 233,581 and also in mechanical U.S. Pat. Nos. 3,532,247, 3,754,640 and 4,052,589.

Notwithstanding such direction in the prior art, either the user sometimes is not well served or the provider is at least inconvenienced. For the provider, special transport and maintenance racks often are required. The user too often gets insufficiently warm food and also has difficulty in accommodating use of the food serving tray for the additional accommodation of the service of beverages.

It is, accordingly, a general object of the present invention to provide a new and improved food serving tray which overcomes deficiencies and shortcomings such as those discussed above.

Another object of the present invention is to provide a new and improved food serving tray which is capable of being manufactured in an economical manner.

A further object of the present invention is to provide a new and improved food service tray which readily adapts to integration within a total food serving system.

In accordance with the present invention, a food serving tray is composed basically of four parts. There is a hood shaped to define a generally planar upper surface and which has a downwardly depending first marginal skirt. A generally planar lid has an upwardly projecting second marginal skirt that is bonded to the first skirt. A generally planar support has a downwardly depending third marginal skirt, and a likewise generally planar base has an upwardly projecting fourth marginal skirt that is bonded to that third skirt. Finally, indexing means is provided on the lid and the support so that the lid lies in mating relationship atop the support. Desirably also included is a liner which matchingly covers the support.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
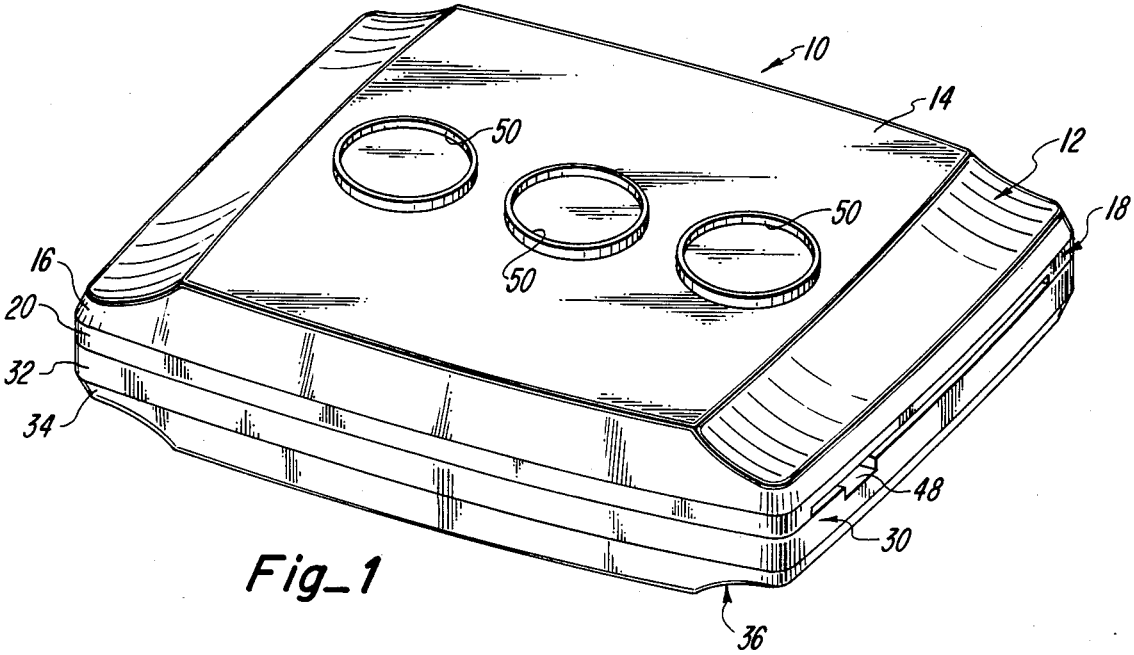
FIG. 1 is an isometric view of a food serving tray.
Figure 2:
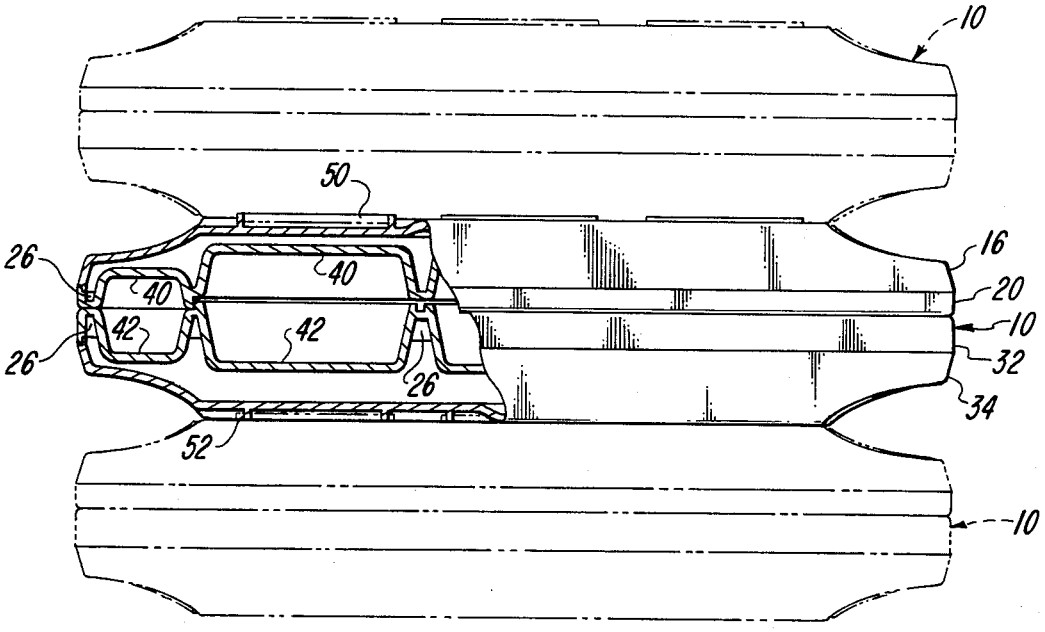
FIG. 2 is a side elevational view of the tray, partially broken away and including a partially phantom representation of a stack of such trays.
Figure 3:
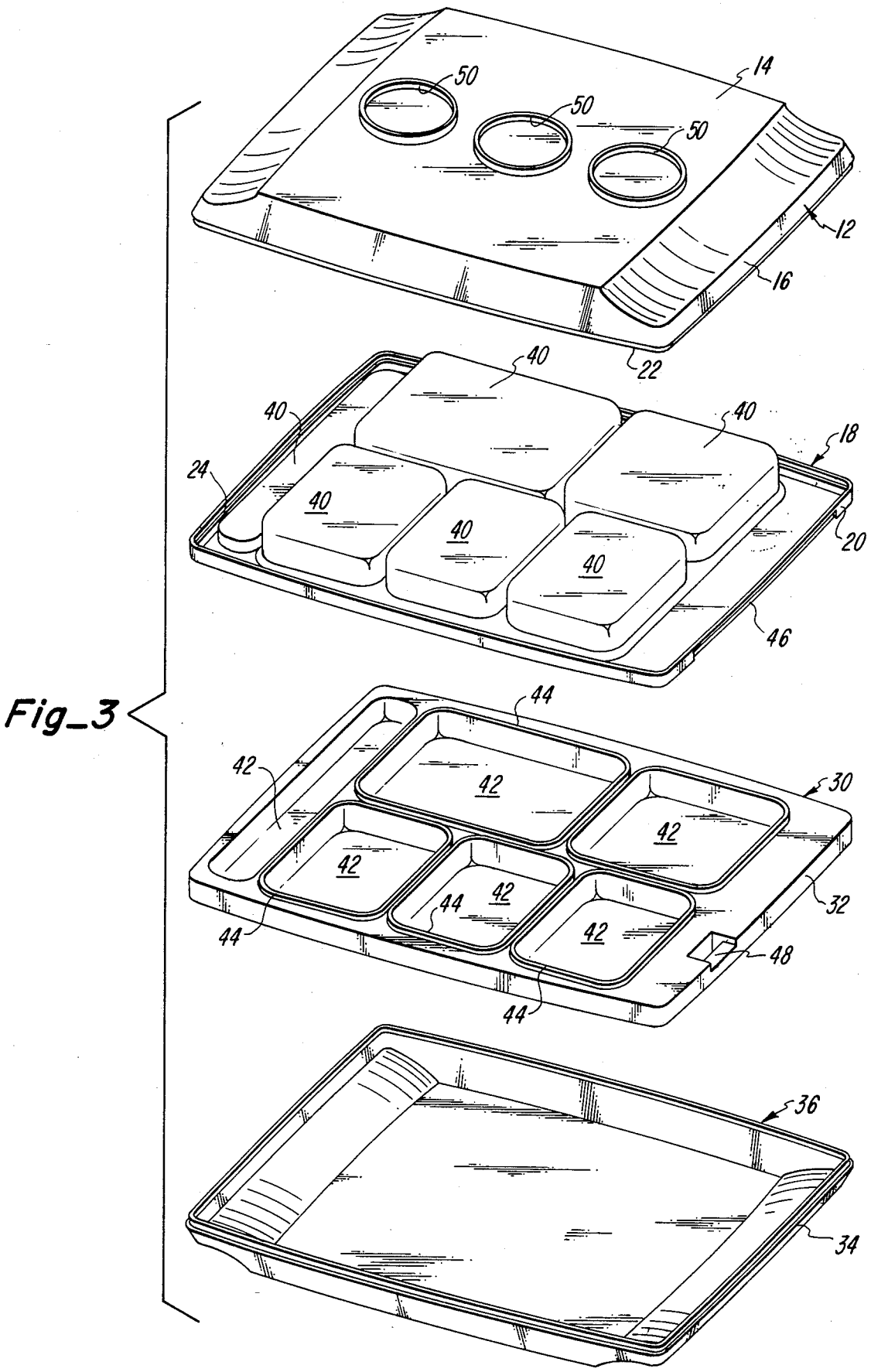
FIG. 3 is an exploded isometric view of the tray from the same perspective as in FIG. 1.
Figure 4:
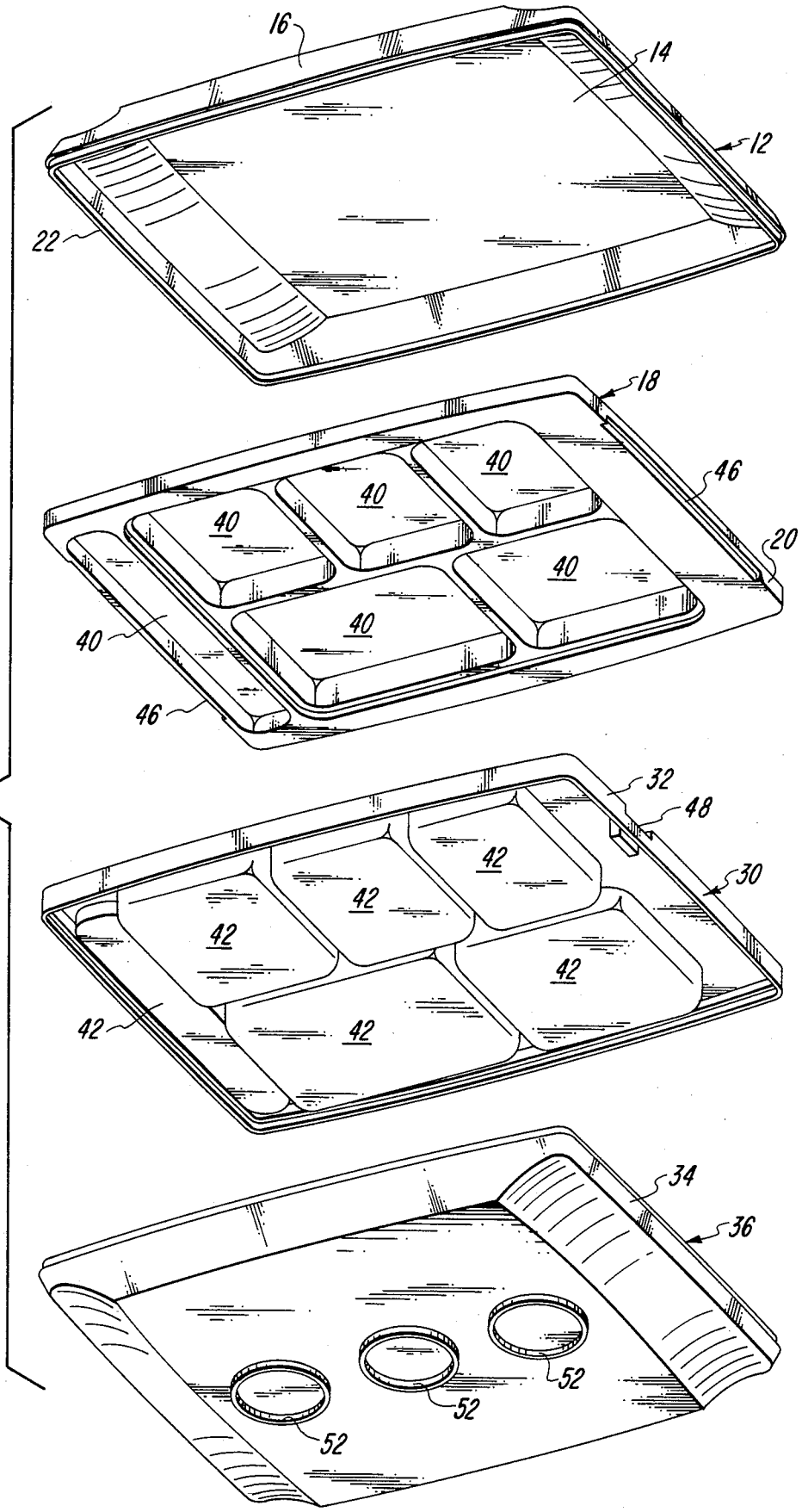
FIG. 4 is an exploded isometric view of the tray as viewed from a reverse perspective.

A food serving tray 10 has as its uppermost element a hood 12 shaped to define a generally planar upper surface 14. Around upper surface 14 is a downwardly depending marginal skirt 16. Below hood 12 is an again generally planar lid 18 which has an upwardly projecting marginal skirt 20 that is bonded to skirt 16. As with the remainder of the assembly yet to be described, all of the components of tray 10 preferably are injection molded from a non-toxic plastic material, such as an ABS plastic that results in the formation of substantially-rigid structure. Accordingly, skirts 16 and 20 may be bonded together by any of a number of different means. In the preferred embodiment, those skirts are ultrasonically welded. To that end, it will be observed that hood 12 has a marginal rib 22 that seats within a recess 24 so as properly to mate those parts. Internally included struts 26 on lid 18 afford structural re-enforcement, so that the major surfaces are rigidified. That same kind of re-enforcement also is incorporated into the lower portion of the ultimate assembly.

That lower portion of the final assembly includes a generally planar support 30 which has a downwardly depending third marginal skirt 32. In turn, it is bonded to the upwardly projecting fourth marginal skirt 34 of a base 36.

Formed upwardly into lid 18 are a distributed plurality of cavities 40. Matable as to position therewith and defined in support 30 are a corresponded distributed plurality of wells 42. When lid 18 is placed atop support 30, therefore, cavities 40 cooperate with wells 42 to define a like plurality of different food compartments.

Upstanding from the perimeter of in this case all but one of each of wells 42 is a lip 44. The outer margins of lips 44 seat within the corresponding margins of cavities 40, so that lid 18 is locked into alignment over support 30. Although not preferred for reasons to become apparent in connection with placement of food and the preferred use of a liner, lips 44 could, instead, depend from lid 18 and nest into wells 42.

In use, accordingly, food may be initially placed into the different ones of wells 42. Because of the existence of cavities 40, that food may be heaped to a higher level than the upper margin of each of the wells. Thereafter, the upper assembly of hood 12 and lid 18 is disposed in covering relationship. By reason of the respective confined air spaces defined within the interiors of the respective upper and lower assemblies, the total heat serving tray assembly serves well to maintain temperatures of the prepared foods for a substantial period of time. Although not apparently necessary for normal use of the trays, further heat insulation may be incorporated as by the filling of those air spaces with a cellular foam. On the other hand, the loaded trays may be placed into a warming oven, warming cart or other device capable of retaining a sufficient elevation of surrounding temperature as to keep the food in serving condition for an extended period of time.

In this case disposed along opposite portions of marginal skirt 20 are indented regions 46. These regions allow the user to insert the tips of his fingers and remove the upper part of the overall assembly and thus expose the food. Also formed into a limited portion of one end of marginal skirt 32 is a shelf 48 that desirably is included to receive a leg of a support that might well carry a card which indicates, for example, any special dietary instructions or at least reveals an identification of that which is stored in the food serving tray.

Disposed on the major upper surface of hood 12 are a plurality of upwardly-facing receptacles 50. At the outset, receptacles 50 enable the server to deposit therein and thereafter carry a cup, glass or other container of a beverage. Even when the subassembly of hood 12 and lid 18 has been removed from the overall tray, the latter may be placed at a nearby location and continue to support such a beverage container(s).

Looking now at the undersurface of base 36, it will be observed that there are a plurality of downwardly-projecting circular feet 52. Those feet correspond in overall position to receptacles 50 and, in this case, are of a slightly smaller diameter so as to fit within the respective ones of receptacles 50. Thus, the combination of receptacles 50 and feet 52 serves to enable secure interlocking for stacking of a plurality of the described food serving trays.

Figure 5:
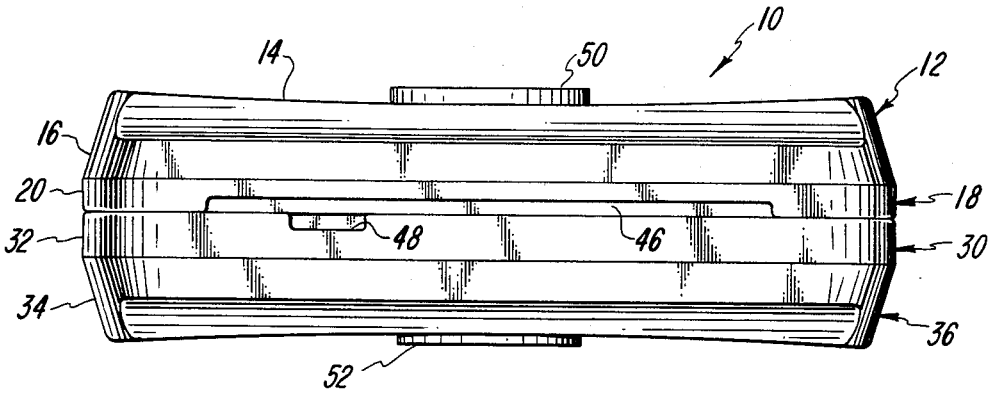
FIG. 5 is an end elevational view of the tray.

Further in connection with the provision of feet 52, it will be noted in FIG. 5 that the major planar surface that faces downwardly and forms a part of base 36 is bowed inwardly toward its longer marginal skirt. The amount of that bow is sufficient to enable the outer side margins of base 36 to rest stably upon any flat surface without interference from feet 52. That bow also tends to enable stacking of the trays without spacing therebetween.

Additional assistance to stable stacking of the trays is afforded by a similar inward bow in upper surface 14 of hood 12. When the trays are stacked, all respective longer sides rest against one another. In this connection, receptacles 50 project upwardly only for a distance sufficient to accept the feet 52 of a next tray and yet allow those respective larger sides to interengage.

The approach described enables hood 12 and base 36 to be produced by use of the same mold cavity. Only different inserts have to be used to change as between production of hood 12 and base 36, the inserts distinguishing as between receptacles 50 and feet 52. At least because shelf 48 and regions 46 could be formed to be redundant and yet accomplish their purposes, lid 18 and support 30 also could be made from the same mold as adapted with inserts to accommodate mating dimensions of those respective components.

Figure 6:
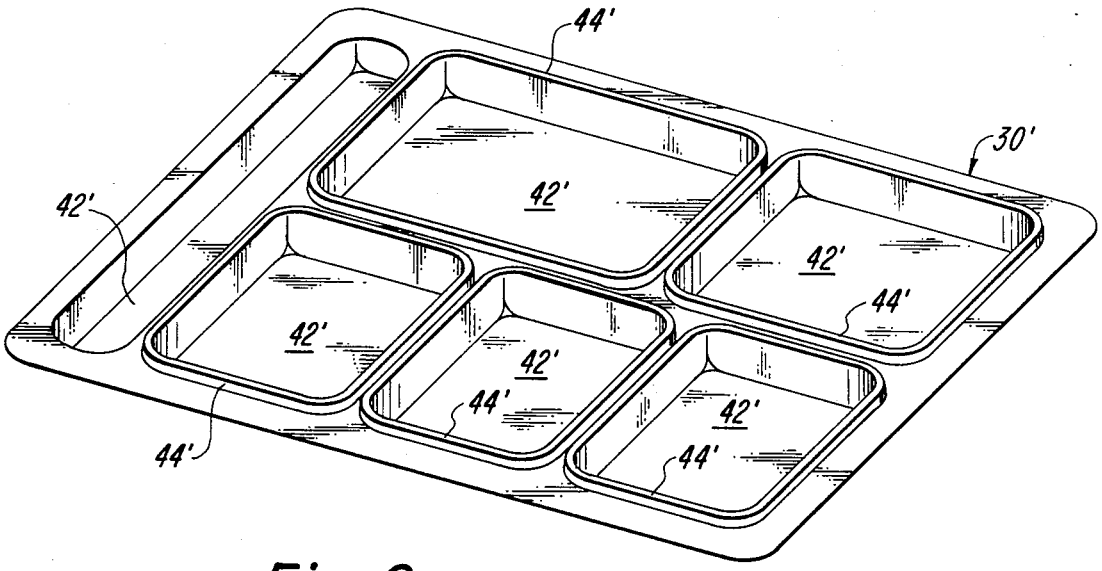
FIG. 6 is an isometric view of a liner that may be seated atop a component shown in others of the figures.

The kind of plastic of which the major components are formed enables satisfactory cleaning between successive uses. Nevertheless, it is preferred to include for use in the combination an additional liner 30' as shown in FIG. 6. Liner 30' is shaped to define wells 42' and hollowed lips 44' distributed in a pattern corresponding to the pattern of wells 42 and lips 44 on support 30. Wells 42' are sized to seat snugly within respective ones of wells 42, and lips 44' are conformed to seat closely over lips 44. Liner 30' is formed of a semi-rigid, non-toxic plastic sheet material examples of which already are well-known in use as liners to be placed over food compartments. Similarly to the function of those, liner 30' is intended to be discarded after its initial use. On the other hand, the inclusion of hollowed lips 44' assists in maintaining the relationship of liner 30' with support 30 during handling of that assemblage.

The described food serving tray serves well both to permit indexing when stacked, to maintain temperatures of stored foods, is of a nature so as to be readily cleanable for re-use and accommodates desired typical utilities such as that involving the serving separately of beverages. Yet, the entire assemblage can be constructed by the simplest of molding and bonding operations.

While a particular embodiment of the invention has been shown and described, it will be obvious to those skilled in the art that changes and modifications may be made without departing from the invention in its broader aspects. Therefore, the aim in the appended claims is to cover all such changes and modifications as fall within the true spirit and scope of that which is patentable.

I claim:

1. A food serving tray having a cover portion and a complementary container portion, said cover portion including a hood element shaped to define a generally planar upper surface peripherally bounded by a downwardly extending marginal skirt, and further including means defining a shallow arcuate depression extending between said marginal skirt portions of said marginal periphery and configured for continuous contact between a pair of oppositely disposed marginal skirt portions with a like pair of skirt portions on a tray stacked thereabove to stably support a plurality of said trays in stacked array;

a lid element having an upwardly projecting marginal skirt bonded to said downwardly extending marginal skirt;

said container portion including a support element having a downwardly depending marginal skirt; and a base element having an upwardly projecting marginal skirt bonded to said downwardly depending marginal skirt on said support portion and defining a shallow arcuate depression extending between said marginal skirt portions of said base and further configured for continuous contact by said pair of oppositely disposed marginal skirt portions with a like pair of oppositely disposed marginal skirt portions of said hood on a tray positioned therebeneath;

means for indexing said cover to lie in interengaging relationship atop said container;

said cover including a distributed plurality of upwardly disposed cavities and said container including a distributed plurality of wells individual ones of which mate with respective different ones of said cavities to define corresponding different food compartments;

a receptacle system extending upwardly from said hood element and shaped to receive a container, said receptacle system being disposed in a central region of said upper surface within said shallow depression and projecting above the outer side margins of said upper surface;

and a matchingly disposed foot system extending downwardly from said base and engageable within the receptacle system in a like tray in stacked array, said foot system projecting downwardly no further than the level of the side margins of the under surface of said base, whereby the side margins of said upper surface and said under surface engage while said receptacle system indexes with said foot system and precludes lateral and rotational displacement of stacked trays with respect to each other in the stack.

2. A food serving tray including a cover portion and a container portion comprising:

said cover including a hood shaped element defining a generally planar upper surface and a downwardly depending marginal skirt, and further including a shallow arcuate depression in said upper surface extending across said hood between portions of said marginal skirt and configured for continuous contact between at least a pair of oppositely disposed marginal skirt portions of said hood and a like pair of skirt portions on a tray stacked thereabove to stably support a plurality of trays in stacked array;;

a generally planar lid element having an upwardly projecting marginal skirt bonded to said downwardly depending skirt on said bond;

said container including a support having a downwardly depending marginal skirt;

a base element having an upwardly projecting marginal skirt bonded to said downwardly depending marginal skirt on said support portion;

said container portion and said cover portion each includng complementary recesses defining food compartments in said tray;

means for indexing said lid to lie in interengaging relationship atop said support;

a receptacle system facing upwardly from said hood within said depressed surface and shaped to receive a container, said receptacle being disposed in a central region of said upper surface and projecting above the outer side margins of said upper surface;

matchingly disposed feet downwardly depending from said base and engageable within a corresponding receptacle in a like tray positioned therebeneath, said feet projecting no further than the level of the side margins of the under surface of said base, whereby the side margins of said upper surface and said under surface engage while said receptacle system indexes with said feet;

said upper surface being arcuately depressed inwardly of the tray, between its marginal skirt, in an amount sufficient to accommodate interengagement of said receptacles and said feet without spacing apart stacked ones of the trays while precluding lateral and relative rotational displacement of trays with respect to each other when in stacked array.

3. A stackable food serving tray comprising in combination:

a cover portion and complementary container portion;

said cover portion including a hood element shaped to define a generally planar arcuately recessed upper surface and having a downwardly depending marginal skirt, said cover further including:

a lid element having an upwardly projecting marginal skirt bonded to said downwardly depending marginal skirt on said hood element;

said container including a food support element having a downwardly depending marginal skirt; said container portion further including:

a base element having an upwardly projecting marginal skirt bonded to said marginal skirt on said food support element;

means for indexing said cover portion in interengaging relationship atop said container portion;

receptacle means extending upwardly from said hood and shaped to receive a container, said receptacle means being disposed in the arcuately depressed upper surface of said hood and projecting above the outer side margins of said upper surface;

matchingly disposed foot means extending downwardly from said base and engageable within said receptacle means in a like tray positioned therebeneath, said foot means projecting no further than the level of the side margins of the under surface of said base, whereby the side margins of said upper surface and said under surface engage while said receptacle indexes with said foot;

said under surface of said base being bowed inwardly between opposed portions of its marginal skirt, in an amount sufficient to enable said base to rest stably upon a flat surface while the interengagement of said receptacle means and said foot means preclude lateral and rotational displacement of said trays with respect to each other when stacked.

4. A tray as defined in claim 1 in which a first plurality of lips project laterally to the surface of said support element within which said wells are defined, in which said first lips are configured to align said wells and said cavities, and a generally planar removable liner having a plurality of permanently defined wells distributed in a pattern and individually sized to nest snugly within corresponding ones of the wells in said support, and in which said liner includes an analogous plurality of second and hollowed lips individually seatable over respective ones of said first lips in nested relation.

5. A food serving tray as defined by claim 1 wherein said tray includes a disposable liner comprising:

a sheet of semi-rigid material in which is permanently defined a plurality of wells individually nestable within said food compartments and atop said container portion of said tray;

a hollowed second lip upstanding from said sheet and conformed to nest over said first lip when said sheet is emplaced atop said container portion and said wells are seated in said compartments.

6. A stackable food serving tray comprising in combination:

a cover portion and a complementary container portion;

said cover portion including a hood element configured to define a major upper surface bounded by side margins and a downwardly extending peripheral skirt terminating in a continuous lip, and a lid element peripherally configured for bonding engagement with said skirt and defining with said hood a substantially hollow cover assembly;

said container portion including a base element configured to define a major lower surface bounded by side margins and an upwardly extending peripheral wall terminating in a continuous lip, and a support element peripherally configured for bonding engagement with said lip of said base and defining a substantially hollow base assembly;

each of said cover portion and said container portion including interengaging indexing means and a distributed plurality of complementary wells individual ones of which mate with respective counterparts to define separate compartments for food products and accessories;

the major surface areas of said hood element and said base element each including a generally shallow concavity extending between at least two opposed marginal portions of said skirt and walls and configured for continuous contact by said pair of oppositely disposed marginal skirt portions of said hood on a tray positioned therebeneath;

receptacle means extending upwardly from the major upper surface of said hood and configured to receive a container therewithin, said receptacle dimensioned to project above the outer side margin portions of said upper surface; and foot means on said major lower surface configured to nest within the receptacle means of a lower tray when a plurality of trays are arranged in stacked array, said foot means configuration being selected to project from said lower surface a distance not in excess of the outer side margins of said base element whereby said foot means of said base will interengage with the receptacle means of said hood of successive trays positioned in stacked array and at least opposed portions of said margins of said base positioned thereabove while the base of the lowermost tray rests stably on a flat surface while precluding lateral and rotational displacement of said stacked trays with respect to each other.

* * * * *